US005998345A

United States Patent [19]

Gorlin et al.

[11] Patent Number: 5,998,345

[45] **Date of Patent: *Dec. 7, 1999**

[54] AUTOMATIC DISHWASHING TABLETS

[75] Inventors: Philip Gorlin, Monmouth Junction; Steve Phillips, Highland Park; Divaker Kenkare, Califon, all of N.J.

[73] Assignee: Colgate Palmolive Company, New York, N.Y.

[ * ] Notice: This patent is subject to a terminal disclaimer.

[21] Appl. No.: 09/276,356

[22] Filed: Mar. 25, 1999

[51] Int. Cl.[6] ..... C11D 7/10; C11D 17/00

[52] U.S. Cl. ..... 510/224; 510/229; 510/233; 510/446; 510/475; 510/495; 510/509; 510/510; 510/511; 510/512

[58] Field of Search ..... 510/224, 229, 510/446, 233, 509, 510, 511, 512, 475, 495

[56] References Cited

U.S. PATENT DOCUMENTS

| | | | |
|---|---|---|---|
| 3,360,469 | 12/1967 | Fuchs | 252/99 |
| 3,361,675 | 1/1968 | Fuchs et al. | 252/99 |
| 3,390,092 | 6/1968 | Keast et al. | 252/99 |
| 3,944,497 | 3/1976 | Alterman et al. | 510/381 |
| 4,219,436 | 8/1980 | Gromer et al. | 510/224 |
| 4,587,031 | 5/1986 | Kruse et al. | 510/224 |
| 4,595,520 | 6/1986 | Heile et al. | 510/380 |
| 4,657,784 | 4/1987 | Olson | 427/213 |
| 4,828,749 | 5/1989 | Kruse et al. | 510/224 |
| 4,892,898 | 1/1990 | Leighton et al. | 524/3 |
| 4,897,212 | 1/1990 | Kruse et al. | 510/224 |
| 5,200,236 | 4/1993 | Lang et al. | 427/213 |
| 5,698,512 | 12/1997 | Austn et al. | 510/475 |

*Primary Examiner*—Lorna M. Douyon

[57] ABSTRACT

An automatic dishwashing composition which is in the form of a tablet generally comprises an alkali metal phosphate detergent builder salt, an alkali metal carbonate, a dialkali metal disilicate, a nonionic surfactant, optional a polymer containing sulfonic acid groups, a wax coated chlorine bleach compound, and a hydrotrope.

6 Claims, No Drawings

AUTOMATIC DISHWASHING TABLETS

FIELD OF THE INVENTION

This invention relates to an improved powdered automatic dishwashing detergent for dishwashing machines which is used in the form of a tablet. More particularly, this invention relates to a tablet dishwashing composition which contains a wax coated bleach and optionally a polymeric builder.

BACKGROUND OF THE INVENTION

Pre-measured amounts of detergent compositions which are compressed into water-soluble tablet form are well known and have received substantial commercial acceptance. They generally comprise a cleaning agent such as a synthetic detergent or soap and a detergency builder which is generally sodium tripolyphosphate (STP), along with suds suppressors, soil suspending agents, bleaching agents, and other ingredients commonly added to washing compositions. They are easy to use, avoid the problem of spillage during use, and prevent the use by the consumer of too much or too little detergent. However, manufactures of dishwashers (especially in the US) produce a wide variety dispenser cups. They vary in shape and size. We have found that certain oval shapes are preferred because they are more likely to be released from the cup into the wash water. Therefore the entire pre-measured amounts of detergent compositions will be dissolved quickly at the beginning of the main wash cycle leading to better cleaning performance. Some tablet compositions may eventually dissolve out of the cup due to the action of hot water in the machine. However, other compositions may cake in the cup and not dissolve completely. It is widely recognized that it is most desirable to have the tablet enter the main wash as soon as possible. This will allow the cleaning agents maximum time to clean dishes and silverware.

U.S. Pat. No. 3,557,003 teaches a detergent tablet containing a builder salt, an inorganic salt, surfactant and an alkali metal soap.

U.S. Pat. No. 3,423,322 teaches a tablet containing sodium tripolyphosphate, surfactant and potassium phosphate.

U.S. Pat. No. 5,133,892 teaches a multi layer tablet which allows the incorporation of both bleach and enzyme.

The present invention teaches a powdered dishwashing composition in the form of an elliptically shaped tablet which is easily dispensed from the cup of the automatic dishwasher and is readily soluble in the wash solution of an automatic dishwashing machine.

SUMMARY OF THE INVENTION

The present invention relates to an automatic dishwashing composition which is in the form of a tablet which generally comprises an alkali metal phosphate detergent builder salt, an alkali metal carbonate and/or an alkali metal citrate, a dialkali metal disilicate, a nonionic surfactant, an alkali metal sulfate, optionally, a polymer containing sulfonic acid groups, a wax coated chlorine bleach compound, a hydrotrope and optionally a clay. The composition is formed into an elliptically shaped tablet.

DETAILED DESCRIPTION OF THE INVENTION

The present invention relates to an automatic dishwashing elliptically shaped tablet which comprises approximately by weight:

(a) 20% to 40% of a sodium tripolyphosphate detergent builder salt;

(b) 10% to 25% of a dialkali metal disilicate or alkali metasilicate or mixtures thereof;

(c) 10% to 40%, more preferably 16% to 35% of a hydrated alkali metal carbonate or alkali metal citrate and mixtures thereof;

(d) 0.1% to 5% of a low foaming nonionic surfactant;

(e) 0 to 5% of a polymer containing sulfonic acid groups; and (f) 0.1% to 1% of a hydrotrope; and (g) 0 to 1.0% of a pigment or dye;

(h) 10% to 25% of sodium sulfate; and (i) 1% to 20% of a wax coated chlorine bleach compound, wherein said wax coated bleach compound contains about 85% to 90 wt. % of the bleach compound and 14 wt. % to 17 wt. % of the wax wherein the wax has a melting point of at least 130° F., more preferably at least 135° F.

The nonionic surfactants that can be used in the present powdered automatic dishwasher detergent compositions at a concentration of 0.08% to 4%, more preferably 0.2% to 3% by weight are well known. A wide variety of these surfactants can be used. The nonionic synthetic organic detergents are generally described as ethoxylated/propoxylated fatty alcohols which are low-foaming surfactants and may be possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amide or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of hydrophilic poly-lower alkoxy group to a lipophilic moiety. A preferred class of the nonionic detergent employed is the poly-lower alkyoxylated higher alkanol wherein the alkanol is of 9 to 18 carbon atoms and wherein the number of moles of lower alkylene oxide (of 2 or 3 carbon atoms) is from 3 to 15. Of such materials, it is preferred to employ those wherein the higher alkanol is a high fatty alcohol of 9 to 11 or 12 to 15 carbon atoms and which contain from 5 to 15 or 6 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atom and which contain about 7 ethylene oxide groups per mold.

Useful nonionics are represented by the low foam Plurafac series from BASF Chemical Company which are the reaction product of a higher linear alcohol and a mixture of ethylene and a propylene oxides, containing a mixed chain of ethylene oxide and propylene oxide, terminated by a hydroxyl group. Examples include Product A (a $C_{12}$–$C_{15}$ fatty alcohol condensed with 6 moles ethylene oxide and 3 moles propylene oxide). Product B (a $C_{12}$–$C_{15}$ fatty alcohol condensed with 7 mole propylene oxide and 4 mole ethylene oxide), and Product C (a $C_{12}$–$C_{15}$ fatty alcohol condensed with 5 moles propylene oxide and 10 moles ethylene oxide). Another group of liquid nonionics are available from Shell Chemical Company, Inc. under the Dobanol trademark: Dobanol 91-5 is a low foam ethoxylated $C_2$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent. Synperonic nonionic surfactant from ICI such as Synperonic LF/D25, LF/RA30 are especially preferred nonionic surfactants that can be used in the powdered automatic dishwasher detergent compositions of the instant invention. Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties, the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The nonionic surfactant is absorbed on a builder system which comprises a mixture of sodium tripolyphosphate phosphate-containing particles, a builder salt of a polymer containing sulfonic acid group and an inorganic detergent builders such as an alkali carbonate such as sodium carbonate or sodium citrate or a mixture of sodium carbonate and sodium citrate. A preferred solid builder salt is an alkali metal polyphosphate such as sodium tripolyphosphate ("TPP").

The water soluble polymer containing sulfonic acid groups which is used in the composition at a concentration of 0 to 5%, more preferably 1% to 4% by weight comprises the polymerization product of at least 2.5 mole percent of an allyloxybenzenesulfonic acid monomer represented by the chemical structure (I):

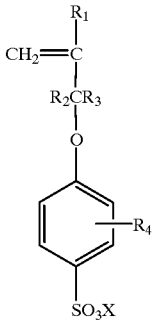

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

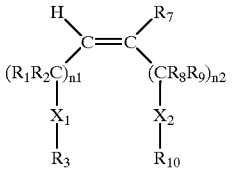

wherein $n_1$ and $n_2$ are independently 0 to 10; $R_1$, $R_2$, $R_8$ and $R_9$ are independently hydrogen, $C_1$–$C_6$ alkyl, or $C_1$–$C_6$alkyl-substituted aryl; $R_7$ is hydrogen, $C_1$–$C_6$ alkyl, or $CO_2X$, where X is hydrogen, an alkali or alkaline earth metal or $C_1$–$C_6$ alky; $X_1$ and $X_2$ are absent or are independently O, C=O, or hydrogen; $R_3$ is absent or is C=O$r_4$, $OR_4$, $NR_5R_6$, $C_1$–$C_{18}$ alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is C=$OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olefinically unsaturated carboxylic acid monomer.

Useful olefinically unsaturated acid monomers include such widely divergent materials as the acrylic acid comonomers typified by acrylic acid itself, methacrylic acid, ethacrylic acid, alpha-chloro-acrylic acid, alpha-cyano acrylic acid, alpha-chloro-acrylic acid, alpha-cyano acrylic acid, beta methyl-acrylic acid (crotonic acid), alpha-phenyl alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, and tricarboxy ethylene. For the polycarboxylic acid monomers, an anhydride group is formed by the elimination of one molecule of water from two carboxyl groups located on the same polycarboxylic acid molecule. The preferred carboxylic monomers for use in this invention are the monoolefinic acrylic acids having a substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. As used herein, (meth)acrylic acid is intended to include acrylic acid and methacrylic acid. The water soluble polymers comprise at least 60 mole percent of the copolymerizable unsaturated carboxylic acid monomer, preferably from 60 to 87 mole percent, more preferably from 70 to 87 mole percent, and even more preferably from 75 to 85 mole percent. Preferred unsaturated carboxylic acid monomers are acrylic and methacrylic acid, more preferably acrylic acid.

These aforementioned polymers are described in U.S. Pat. No. 5,547,612. A preferred water soluble polymer is Alcosperse 240—manufactured by Alco Chemical having a molecular weight of about 8,000.

The alkali metal silicates are useful anti-corrosion agents in the composition and which function to make the composition anti-corrosive to eating utensils and to automatic dishwashing machine parts. The dialkali metal silicates such as sodium silicates of $Na_2O:SiO_2$ have ratios of from 1:1 to 1:2.4 Potassium silicates of the same ratios can also be used. The preferred silicates used at a concentration of 8% to 24%, more preferably 12% to 22% are selected from the group consisting dialkali metal silicates and alkali metal silicates and mixtures thereof a sodium metasilicate used at a concentration of 8% to 14% and more preferably at 12% to 12% by weight.

The hydrotrope is used in the composition at a concentration of 0.08% to 0.8%, more preferably 0.1% to 7% by weight and are selected from the group consisting of alkali metal or alkaline earth metal salts of xylene sulfonate or cumene sulfonate, wherein sodium xylene sulfonate is preferred.

The wax coated chlorine bleach compound contains 60 wt. % to 90 wt. % of the chlorine bleach compound and 10 wt. % to 40 wt. % of a wax which is coated onto the particles of the chlorine bleach compound thereby encapsulating the chlorine bleach compound within the wax coating.

Any chlorine bleach compound may be employed in the compositions of this invention, such as dichloroisocyanurate, dichlorodimethylhydantoin, or chlorinated TSP. The composition should contain sufficient chlorine bleach compound to provide about 0.2 to 4.0% by weight of available chlorine, as determined, for example, by acidification of 100 parts of the composition with excess hydrochloric acid. The preferred bleach is sodium dichloroisocyanurate dihydrate which is used at a concentration of 0.2% to 5%, more preferably 0.5% to 4% by weight of the total weight of the tablet.

The wax coating comprises a paraffin wax which has a melting point of at least 130° F., more preferably at least 135° F.

One paraffin wax is Astorwax 3516 Scale Wax (Astor Corp.) which is a clay treated paraffin wax which is a complex mixture of petroleum hydrocarbons having a melting point of at least 135° F. and less than 0.5 wt. %.

The clays which can be optionally used in the instant compositions are the inorganic, colloid-forming clays of smectite and/or attapulgite types. These materials are generally used in amounts of about 0 to 10 wt. %, preferably 1 to 5 wt. % and are contained in the outer layers of the tablet.

Smectite clays include montmorillomite (bentonite), hectorite, smectite, saponite, and the like. Montmorillonite clays are available under tradenames such as Thixogel (Registered trademark) No. 1 and Gelwhite (Registered trademark) GP, H, etc., from Georgia Kaolin Company; and ECCAGUM (Registered trademark) GP, H, etc., from Luthern Clay Products. Attapuligite clays include the materials commercially available under the tradename Attagel (Registered trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. An especially preferred clay is a bentonite clay containing a blue, green or pink dye which is manufactured by Larivosa Chimica Mineraria, S.p.A. and manufactured under the name of Detercal P4™, wherein the bentonite clay is used at a concentration of about 0 to 10 wt. %, more preferably 1 wt. % to 5 wt. %.

The instant tablets can also contain 0 to 5.0 wt. %, more preferably 0.1% to 4% by weight of a fragrance. The instant compositions can optionally contain 0 to 15 wt. % of a lipase, protease or amylase enzyme and mixtures thereof.

EXAMPLE 1

In wt. % wax coated bleach particles were prepared and tested. The coating is applied by spraying the molten wax into a fluid bed containing the NaDCC. For optimal coating, the NaDCC particles should be large and of a narrow size distribution. In this example, particles of 10–20 mesh size were used (Clearon Corp., special extra coarse grade). Astorwax 3516 (Afterwax Corp.) is the preferred wax in this invention. The melting point of this wax is 135° F. Waxes with lower melting points (e.g., Astorwax 1750 m.p. 117° F.) cannot be used to coat the NaDCC, because the use of lower melting waxes results in very sticky particles which do not stay flowable. It was found that the use of the higher melting wax prevents this.

| | A | B | C | D | E |
|---|---|---|---|---|---|
| NaDCC.2H2O | 80 | 80 | 71 | 80 | 80 |
| Astorwax 3516 | 16 | 20 | 25 | | |
| Astorwax 1750 | | | | 16 | 20 |
| Zeolite A | 4 | | 4 | 4 | |
| Physical Properties | | | | | |
| Flowability | good | fair | good | good | poor |
| Flowability (aged 1 week at 120° F.) | good | | good | very poor | |
| Bleach Release 120° F. | | | | | |
| % release - 1 minute | 14 | | 19 | 84 | |
| % release - 3 minutes | 63 | | 39 | 94 | |
| % release - 5 minutes | 84 | | 49 | 90 | |
| % release - 7 minutes | 85 | | 62 | 88 | |

The powder formulas A-G used in this invention are made by mixing the individual ingredients and then coating with a mixture of the liquid nonionic surfactant, pigment or dye, and fragrance. Tablets are made by pressing the powders using a Carver hand press and stainless steel tooling. Single layer tablets are pressed to 15000 psi.

The wax-coated sodium dichloroisocyanurate dihydrate was prepared in the following manner. The paraffin wax was melted in a beaker and sodium dichloroisocyanurate dihydrate was mixed into the liquid wax until the wax fully coated the bleach particles. The mixture was then allowed to begin cooling with constant mixing and a flow aid was then mixed into the wax mixture. Suitable flow aids include anhydrous sodium tripolyphosphate, anhydrous sodium carbonate, sodium aluminosilicate (zeolite A), sodium stearate, clays, or other inert powders. The resulting particles are free-flowing.

The use of the higher melting wax allows for the particle to survive storage at elevated temperatures possible during transport/storage and still remain flowable. In addition, the use of the higher melting wax allows for a delay in the release of the bleach at 120° F., the typical household wash temperature in the U.S., while still delivering the same amount of bleach a few minutes into the wash. Using a thinner wax coating (lower wax level) is preferred, since this allows the bleach to be introduced into the wash more quickly. The delayed bleach release allows for more flexibility in formulating. For example, enzymes cannot be used in typical chlorine bleach-containing automatic dishwashing compositions because of their almost immediate deactivation by chlorine bleach in the main wash. Delaying the release of DCC in the main wash by using a higher melting wax allows for the enzymes to effectively work for a short period before the DCC is activated.

Automatic dishwashing formulas were made incorporating the coated bleach particles. These formulas are especially useful for making automatic dishwashing tablets, since NaDCC is not generally stable in automatic dishwashing tablets unless isolated from the bound water molecules introduced by other automatic dishwashing ingredients.

| | Formula B | | | |
|---|---|---|---|---|
| | F | G | H | I |
| Na TPP | 33.5 | 33.5 | 33.5 | 33.5 |
| Na carbonate | 27 | 27 | 27 | 27 |
| Na disilicate (47.5%) | 15.2 | 15.2 | 15.2 | 15.2 |
| Na sulfate | 17 | 16.5 | 17 | 18.1 |
| Nonionic surfactant | 2 | 2 | 2 | 2 |
| Sodium stearate | 0.3 | 0.3 | 0.3 | 0.3 |
| Fragrance | 0.2 | 0.2 | 0.2 | 0.2 |
| Coated particle (Formula A) | 4.4 | | | |
| Coated particle (Formula C) | | 4.9 | | |
| Coated particle (Formula D) | | | 4.4 | |
| Na DCC dihydrate (uncoated) | | | | 3.5 |
| Bleach remaining (%) (2 wk at 100° F./80% R.H.) | 95 | 95 | 87 | 76 |

Automatic dishwashing tablets made with wax-coated DCC show improved bleach stability vs. Tablets made with untreated DCC when stored for two weeks at 100° F. and 80% relative humidity.

Tablets made using a wax melting above the typical wash temperature of 120° F. will slow the release of bleach into the wash cycle and allow for more formulation flexibility. One option would be to incorporate enzymes into the composition, which typically are not compatible with chlorine bleach-containing automatic dishwashing. The bleach release rates for two of the compositions are show below (GE machines, 120° F., 150 ppm water hardness). The formula using the DCC coated with the higher melting wax (135° F.) initially releases the bleach more slowly than the formula using the DCC coated with the lower melting wax (117° F.), but after 9 minutes into the wash, the available chloring in the water is equal. This slower initial release of bleach during the wash cycle can add some flexibility in formulating. For examples, enzymes can be incorporated into the formula.

| Example | time (min) | % available chlorine in wash water |
|---|---|---|
| Formula G | 3 | 0.34 |
| (wax m.p. 135° F.) | 6 | 0.94 |
| | 9 | 1.37 |
| Formula H | 3 | 0.75 |
| (wax m.p. 117° F.) | 6 | 1.19 |
| | 9 | 1.36 |

What is claimed is:

1. An automatic dishwashing tablet which comprises approximately by weight:

(a) 20% to 40% of an alkali metal phosphate detergent builder salt;

(b) 10% to 25% of a dialkali metal disilicate and/or alkali metal meta silicate;

(c) 10 to 40% of an alkali metal carbonate and/or alkali metal citrate;

(d) 0.1% to 5% of a low foaming nonionic surfactant;

(e) 0 to 5% of a polymer containing sulfonic acid groups;

(f) 0.1% to 1% of a hydrotrope; and (g) 0 to 1.0% of a pigment or dye;

(h) 10% to 25% of sodium sulfate; and (i) 1% to 30% of a paraffin wax coated chlorine bleach compound wherein said paraffin wax coated chlorine bleach compound contains 60 wt % to 90% wt % of the chlorine bleach compound, 10 wt % to 40 wt % of the paraffin wax and sodium aluminosilicate as a flow aid, and wherein the paraffin wax has a melting point of at least 135° F.

2. The composition of claim 1 wherein the dialkali metal disilicate is disodium disilicate.

3. The composition of claim 1 wherein said alkali metal carbonate is sodium carbonate.

4. The composition of claim 3 wherein said nonionic surfactant is a condensation product of a fatty alcohol, ethylene oxide and propylene oxide.

5. The composition of claim 4 wherein said chlorine bleach compound is sodium dichloroisocyanurate.

6. The composition of claim 5 wherein said polymer containing sulfonic acid groups comprises the polymerization product of at least 2.5 mole percent of an allyloxybenzenesulfonic acid monomer represented by the chemical structure (I):

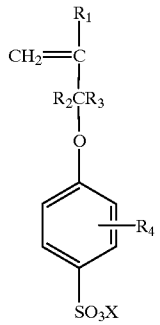

wherein $R_1$, $R_2$, $R_3$ and $R_4$ are independently hydrogen or $C_1$–$C_6$ alkyl; X is hydrogen, an alkali or alkaline earth metal or ammonium, at least 0.5 mole percent of a methallylsulfonic acid monomer, from 10 to 20 mole percent of a copolymerizable nonionic monomer represented by the chemical structure (III):

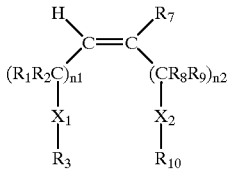

wherein $n_1$ and $n_2$ are independently 0 to 10; $R_1$, $R_2$, $R_8$ and $R_9$ are independently hydrogen, $C_1$–$C_6$ alkyl, or $C_1$–$C_6$ alkyl-substituted aryl; $R_7$ is hydrogen, $C_1$–$C_6$ alkyl, or $CO_2X$, where X is hydrogen, an alkali or alkaline earth metal or $C_1$–$C_6$ alkyl; $X_1$ and $X_2$ are absent or are independently O,C=0, or hydrogen; $R_3$ is absent or is $C{=}OR_4$, $CR_4$, $NR_5R_6$, $C_1$–C_alkyl or hydrogen, where $R_4$ is $C_1$–$C_{18}$ alkyl or hydrogen and $R_5$ and $R_6$ are independently hydrogen, $C_1$–$C_6$ alkyl, or an alkyloxyether or alcohol; and $R_{10}$ is absent or is $C{=}OR_{11}$, $OR_{11}$, $NR_{12}R_{13}$, $C_1$–$C_{18}$ alkyl, or hydrogen, where $R_{11}$ is $C_1$–$C_{18}$ alkyl or hydrogen, $R_{12}$ and $R_{13}$ are independently hydrogen, $C_1$ to $C_6$ alkyl, or an alkyloxyether or alcohol; and at least 60 mole percent of a copolymerizable olefinically unsaturated carboxylic acid monomer.

* * * * *